US006533378B2

(12) United States Patent
Ishikawa

(10) Patent No.: US 6,533,378 B2
(45) **Date of Patent: *Mar. 18, 2003**

(54) METHOD AND APPARATUS FOR EFFECTING THE VOLUME OF AN INK DROPLET

(75) Inventor: Hiroyuki Ishikawa, Nisshin (JP)

(73) Assignee: Brother Kogyo Kabushiki Kaisha, Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/200,952

(22) Filed: Nov. 30, 1998

(65) Prior Publication Data

US 2002/0047872 A1 Apr. 25, 2002

(30) Foreign Application Priority Data

Dec. 17, 1997 (JP) ..... 9-348264

(51) Int. Cl.[7] ..... B41J 29/38
(52) U.S. Cl. ..... 347/10
(58) Field of Search ..... 347/15, 11, 10, 347/68–72, 12

(56) References Cited

U.S. PATENT DOCUMENTS 5,028,936 A 7/1991 Bartky et al.
5,278,626 A * 1/1994 Poole et al. ..... 356/36
5,764,247 A * 6/1998 Asai ..... 347/10
5,764,256 A * 6/1998 Zhang ..... 347/10 X
5,880,750 A * 3/1999 Takahashi ..... 347/10
5,909,228 A * 6/1999 Takahashi ..... 347/10
6,126,278 A * 10/2000 Yoshida ..... 347/10 X

FOREIGN PATENT DOCUMENTS

JP 61-120764 6/1986
JP 63-247051 10/1988
JP 6-84073 3/1994

* cited by examiner

*Primary Examiner*—Hezron Williams
*Assistant Examiner*—C Dickens
(74) *Attorney, Agent, or Firm*—Oliff & Berridge, PLC

(57) ABSTRACT

An ink drop let jetting method and an apparatus are provided to easily and arbitrarily control a volume of ink droplets without changing the voltage value of a jet pulse. Thus, printing with a desired resolution may be achieved. When the volume of ink droplets (or printing density) is increased, the printing frequency of a timing period of the jet pulse is set to a reciprocal of an even-numbered multiple of the time T in which a pressure wave propagates within an ink chamber in one-way. Also, when the volume of ink droplets is decreased, the printing frequency is set to a reciprocal of an odd-numbered multiple of the time T in which a pressure wave propagates within an ink chamber in one-way. Alternatively, printing is executed at intermediate frequencies. According to this method, it becomes possible to print dots with an arbitrary resolution.

20 Claims, 8 Drawing Sheets

METHOD AND APPARATUS FOR EFFECTING THE VOLUME OF AN INK DROPLET

BACKGROUND OF THE INVENTION

1. Field of Invention

The invention relates to an ink droplet ejecting method and apparatus of an ink jet type.

2. Description of Related Art

According to a known ink jet printer, the volume of an ink flow path is changed by deformation of a piezoelectric ceramic material, and when the flow path volume decreases, the ink present in the ink flow path is ejected as a droplet from a nozzle, while when the flow path volume increases, the ink is introduced into the ink flow path from an ink inlet. In this type of a printing head, a plurality of ink chambers are formed by partition walls of a piezoelectric ceramic material, and an ink supply device, such as ink cartridges are connected to one end of each of the multiple ink chambers, while at the opposite end of each of the ink chambers are provided ink ejecting nozzles (hereinafter referred to simply as "nozzles"). The partition walls are deformed in accordance with printing data to make the ink chambers smaller in volume, whereby ink droplets are ejected onto a printing medium from the nozzles to print, for example, a character or a figure.

As this type of an ink jet printer, a drop-on-demand type ink jet printer which ejects ink droplets is popular because of a high ejection efficiency and a low running cost. As an example of the drop-on-demand type there is known a shear mode type using a piezoelectric material, as is disclosed in Japanese Published Unexamined Patent Application No. Sho 63-247051.

As shown in FIGS. 7A-8, this type of an ink droplet ejecting apparatus 600 comprises a bottom wall 601, a top wall 602 and shear mode actuator walls 603 located therebetween. The actuator walls 603 each comprise a lower wall 607 bonded to the bottom wall 601 and polarized in the direction of arrow 611 and an upper wall 605 formed of a piezoelectric material, the upper wall 605 being bonded to the top wall 602 and polarized in the direction of arrow 609. Adjacent actuator walls 603, in a pair, define an ink chamber 613 therebetween, and next adjacent actuator walls 603, in a pair, define a space 615 which is narrower than the ink chamber 613.

A nozzle plate 617 having nozzles 618 is fixed to one end of each of the ink chambers 613, while to the opposite end of each of the ink chambers is connected an ink supply source (not shown). On both side faces of each actuator wall 603 are formed electrodes 619 and 621, respectively, as metallized layers. More specifically, the electrode 619 is formed on the actuator wall 603 on the side of the ink chamber 613, while the electrode 621 is formed on the actuator wall 603 on the side of the space 615. The surface of the electrode 619 is covered with an insulating layer 630 for insulation from ink. The electrode 621 which faces the space 615 is connected to a ground 623, and the electrode 619 provided in each ink chamber 613 is connected to a controller 625 which provides an actuator drive signal to the electrode.

The controller 625 applies a voltage to the electrode 619 in each ink chamber, whereby the associated actuator walls 603 undergo a piezoelectric thickness slip deformation in directions to increase the volume of the ink chamber 613.

For example, as shown in FIG. 8, when voltage E(V) is applied to an electrode 619*c* in an ink chamber 613*c*, electric fields are generated in directions of arrows 631 and 632 respectively in actuator walls 603*e* and 603*f*, so that the actuator walls 603*e* and 603*f* undergo a piezoelectric thickness slip deformation in directions to increase the volume of the ink chamber 613*c*. At this time, the internal pressure of the ink chamber 613*c*, including a nozzle 618*c* and the vicinity thereof, decreases. The applied state of the voltage E(V) is maintained for only a one-way propagation time T of a pressure wave in the ink chamber 613. During this period, ink is supplied from the ink supply source.

The one-way propagation time T is a time required for the pressure wave in the ink chamber 613 to propagate longitudinally through the same chamber. Given that the length of the ink chamber 613 is L and the velocity of sound in the ink present in the ink chamber 613 is a, the time T is determined to be T=L/a.

According to the theory of pressure wave propagation, upon the lapse of time T or an odd-multiple time thereof after the above application of voltage, the internal pressure of the ink chamber 613 reverses into a positive pressure. In conformity with this timing, the voltage being applied to the electrode 621*c* in the ink chamber 613*c* is returned to 0(V). As a result, the actuator walls 603*e* and 603*f* revert to their original state (FIG. 7A) before the deformation, whereby a pressure is applied to the ink. At this time, the above positive pressure and the pressure developed by reverting of the actuator walls 603*e* and 603*f* to their original state before the deformation, are added together to afford a relatively high pressure in the vicinity of the nozzle 618*c* in the ink chamber 613*c*, whereby an ink droplet is ejected from the nozzle 618*c*. An ink supply passage 626 communicating with the ink chamber 613 is formed by members 627 and 628.

Heretofore, when this kind of ink droplet jet apparatus 600 prints while the resolution varies, it is necessary to obtain dot diameters matched with respective resolutions by changing the volume of each droplet of ink. As a method of changing the volume of a droplet of ink, there is a known method of changing the volume of droplet of ink by changing the voltage value of a jet pulse. In that case, a plurality of voltage sources are required which makes the ink droplet jet apparatus unavoidably expensive.

Also, as shown in Japanese Published Unexamined Application No. Hei 6-84073, there is a known method in which a time period ranging from the trailing edge of a pulse voltage to the leading edge of the next pulse voltage is set to ½ of the natural vibration period of a nozzle portion, considering an influence of meniscus vibration resulting from ink-jetting. However, according to this method, for the purpose of effectively utilizing the energy required when the pulse voltage rises, the vibration of the next ink-jetting period is overlapped on the vibration generated when a piezoelectric element returns after the ink-jetting vibration was stopped. Thus, this method does not provide a countermeasure executed in the continuous vibration periods at a high printing frequency.

Moreover, as shown in Japanese Published Unexamined Patent Application No. Sho 61-120764, there is a known method in which a drive signal for a piezoelectric element is controlled with reference to a dot interval in such a manner that the volume of droplets of ink becomes constant regardless of the dot interval. However, this known method is also not able to change resolutions of continuous dots.

SUMMARY OF THE INVENTION

The invention provides an ink droplet ejecting method and apparatus in which volumes of droplets of ink may be controlled arbitrarily with ease without changing the voltage value of a jet pulse and allowing a desired resolution to be printed.

According to an aspect of the invention, there is provided an ink droplet ejecting method in which a pressure wave is generated within an ink chamber by applying a jet pulse signal to an actuator which changes the capacity of the ink chamber by applying pressure to the ink thereby jetting droplets of ink from a nozzle. The ink droplet ejecting method includes jetting droplets of ink by applying a single jet pulse or a plurality of jet pulses to the actuator at a predetermined timing period in accordance with a printing command for a single dot or a plurality of continuous dots, and changing the predetermined timing period in response to a desired volume of ink droplets. In this method, by setting a timing period of a jet pulse signal, that is, setting the printing frequency to a predetermined value corresponding to a multiple of a time T in which a pressure wave within the ink chamber propagates one-way, a volume of droplet of ink per dot to be jetted may be controlled, and it becomes possible to execute printing with a dot diameter corresponding to a particular resolution.

Also, according to another aspect of the invention in the ink droplet ejecting method, the printing frequency of the predetermined timing period is set to be a reciprocal of an even-number multiple of the time T in which a pressure wave propagates within the ink chamber one-way when the ink droplet volume of each dot is increased. In this method, by setting the printing frequency to a predetermined value, it is possible to increase the speed of droplets of ink per dot to be jetted and to also increase a volume of each droplet.

Also, according to another aspect of the invention in the ink droplet ejecting method, a printing frequency of the predetermined timing period is set to be a reciprocal of an odd-number multiple of the time T in which a pressure wave propagates within the ink chamber one-way when the ink droplet volume of each dot is decreased. In this method, by setting the printing frequency to a predetermined value, it is possible to lower the speed of droplets of ink per dot to be jetted and to decrease the volume of each droplet.

According to another aspect of the invention, the ink droplet ejecting method includes jetting droplets of ink by applying a single jet pulse or a plurality of jet pulses to the actuator at a predetermined timing period in accordance with a printing command for a single dot or a plurality of continuous dots and changing the timing corresponding to a multiple of a time T in which a pressure wave within the ink chamber propagates one-way in response to a printing density. In this method, the timing period (i.e., printing frequency) is set to a predetermined value relative to a multiple of the time T, whereby a droplet volume suitable for printing at a desired printing density may be obtained.

According to another aspect of the invention, in the ink droplet ejecting method, a printing frequency of the predetermined timing period is set to be a reciprocal of an even-number multiple of the time T in which a pressure wave propagates within the ink chamber one-way when the printing density is high. Alternatively, the printing frequency of the predetermined timing period is set to be a reciprocal of an odd-number multiple of the time T in which a pressure wave propagates within the ink chamber one-way when a printing density is low. In this method, by setting a printing frequency to a predetermined value in response to a high or low printing density, it is possible to increase or decrease the speed and volume of droplets of ink per dot to be jetted.

According to another aspect of the invention, an ink droplet ejecting apparatus is provided which includes an ink chamber containing a quantity of ink, an actuator for changing the capacity of the ink chamber, a driving power source for applying an electrical signal to the actuator, and a controller that increases the capacity of the ink chamber by applying a jet pulse signal to the actuator from the driving power source to generate a pressure wave within the ink chamber. The pressure wave creates pressure to the quantity of ink contained in the ink chamber and decreases the capacity from an increased state to a natural state after an odd-number multiple of T has elapsed (where T represents a time in which the pressure wave propagates within the ink chamber one-way), thereby jetting droplets of ink. The controller jets droplets of ink by applying a single jet pulse signal or a plurality of jet pulse signals to the actuator from the driving power source at a predetermined timing period in accordance with a printing command for a single dot or a plurality of continuous dots and changes the timing corresponding to a multiple of a time T in which a pressure wave within the ink chamber propagates one-way in response to a desired ink droplet volume for each dot.

Also, according to another aspect of the invention in the ink droplet ejecting apparatus, a printing frequency of the predetermined timing period is set to be a reciprocal of an even-number multiple of the time T in which a pressure wave propagates within the ink chamber one-way when the ink droplet volume of each dot is increased.

Also, according to an aspect of the ink droplet ejecting apparatus of the invention, the printing frequency of the predetermined timing period is set to be a reciprocal of an odd-number multiple of the time T in which a pressure wave propagates within the ink chamber one-way when the ink droplet volume of each dot is decreased.

Also, according to another aspect of the invention, the controller jets droplets of ink by applying a single jet pulse signal or a plurality of jet pulse signals to the actuator from the driving power source at a predetermined timing period in accordance with a printing command for a single dot or a plurality of continuous dots and changes the timing corresponding to a multiple of a time T in which a pressure wave within the ink chamber propagates one-way in response to a printing density.

According to another aspect of the invention, the printing frequency of the predetermined timing period may be set to a range centered around a reciprocal of an even-numbered multiple of the time T in which a pressure wave propagates within the ink chamber one-way when the printing density is increased. The range may be defined as $(2N-0.4)\times T$ to $(2N+0.4)\times T$, wherein N is an integer.

In addition, the printing frequency of the predetermined timing period may be set to be a range centered around a reciprocal of an odd-numbered multiple of the time T in which a pressure wave propagates within the ink chamber one-way when the printing density is decreased. The range may be defined as $(2N-1.4)\times T$ to $(2N-0.6)\times T$, wherein N is an integer.

Also, according to another aspect of the ink droplet ejecting apparatus of the invention, the printing frequency of the predetermined period timing is set to be a reciprocal of an even-number multiple of the time T in which a pressure wave propagates within the ink chamber one-way when the printing density is high, and the printing frequency of the predetermined timing period is set to be a reciprocal of an odd-number multiple of the time T in which a pressure wave propagates within the ink chamber one-way when the printing density is low.

As described above, according to the ink droplet ejecting method and apparatus of the invention, if the timing period of the jet pulse signal (i.e., the printing frequency) is set to a predetermined value, then without changing the voltage value of the jet pulse, the volume of droplet of ink per dot to be jetted may be controlled easily and arbitrarily, thereby making it possible to print dots with a desired resolution. Then, when the volume of the droplets of ink of each dot increases, the printing frequency of the timing period is set to the reciprocal of an even-numbered multiple of the time T in which the pressure wave propagates within the ink chamber. When the volume of droplet of ink of each dot is decreased, the printing frequency of the timing period is set to the reciprocal of the an odd-numbered multiple of the time T in which the pressure wave propagates within the ink chamber. In this manner, printing according to a desired printing density or desired printing resolution, is possible.

BRIEF DESCRIPTION OF THE DRAWINGS

A preferred embodiment of the present invention will be described in detail with reference to the following figures wherein.

DETAILED DESCRIPTION OF PREFERRED EMBODIMENTS

An embodiment of the invention will hereinafter be described with reference to the drawings. An arrangement of a mechanical portion in the ink droplet ejecting apparatus according to this embodiment is similar to that of the apparatus shown in FIGS. 7A and 7B, and therefore need not be described.

An example of the concrete sizes of the ink droplet jetting apparatus 600 will be described. A length L of an ink chamber 613 is 15 mm. A size of a nozzle 618 is such that the diameter of an ink droplet jetting side is 40 $\mu$m, the diameter of an ink chamber 613 side is 72 $\mu$m, and the length is 100 $\mu$m. A viscosity of ink used in the experiments is about 2 mPas at 25° C. and its surface tension is 30 mN/m. A ratio L/a (=T) of the speed of sound a in the ink contained in this ink chamber 613 and the above-mentioned length L, was 15 $\mu$sec.

Figure 1A:
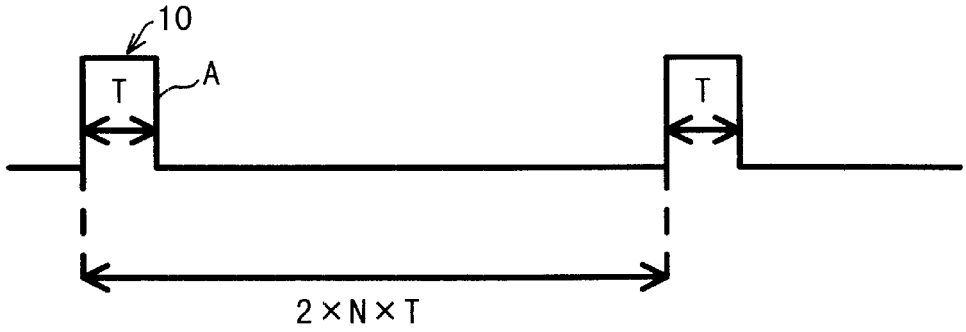
FIGS. 1A and 1B are diagrams showing driving waveforms of an ink droplet jetting apparatus according to an embodiment of the invention.
Figure 1B:
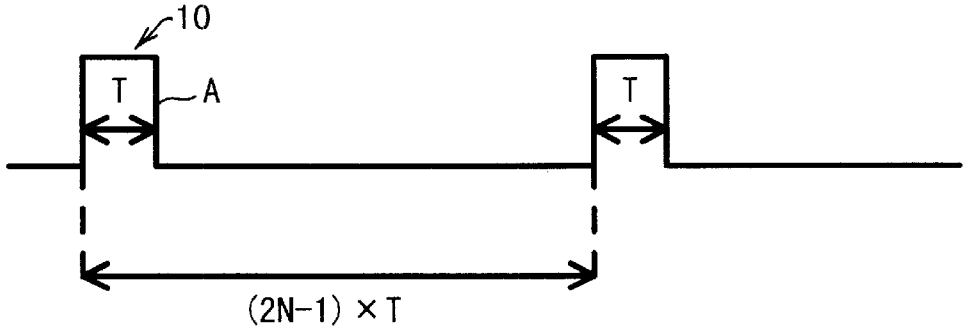

FIGS. 1A and 1B show waveforms of a driving voltage applied to an electrode 619 disposed within the ink chamber 613 according to an embodiment of the invention. An illustrated driving waveform 10 is a jet pulse signal A which is used to jet droplets of ink when each dot is printed. A peak value (voltage value) is 20 (V), for example.

An amplitude of the jet pulse signal A agrees with the odd-number multiple of the ratio L/a (=T) between the speed of sound a in the ink contained within the ink chamber 613 and the above-mentioned length L (value inherent in the head), and T=15 $\mu$sec, for example. A pulse period required when the next dots are printed continuously becomes 100 $\mu$sec (this becomes about 6.66T when T=15 $\mu$sec) when a drive frequency is set to 10 kHz (frequency is a reciprocal of period).

According to this embodiment, droplets of ink are jetted by applying a single jet pulse signal or a plurality of jet pulse signals A to the actuator at a predetermined timing period in accordance with a printing command for a single dot or a plurality of continuous dots. The predetermined timing period is changed in response to a desired volume of droplets of ink for each dot.

For example, in FIG. 1A the frequency of the driving waveform 10 is a reciprocal of an even numbered multiple of the pulse period T of jet pulse signals A. Therefore, the time between jet pulse signals A for the example in FIG. 1A is 2N×T, where N is an integer.

Furthermore, in FIG. 1B the frequency of the driving waveform 10 is a reciprocal of an odd numbered multiple of the pulse period T of jet pulse signals A. Therefore, the time between jet pulse signals A for the example in FIG. 1B is (2N−1)×T, where N is an integer. These examples will become clear from measured data of jetted ink droplets in FIG. 2, which will be described below.

Figure 2:
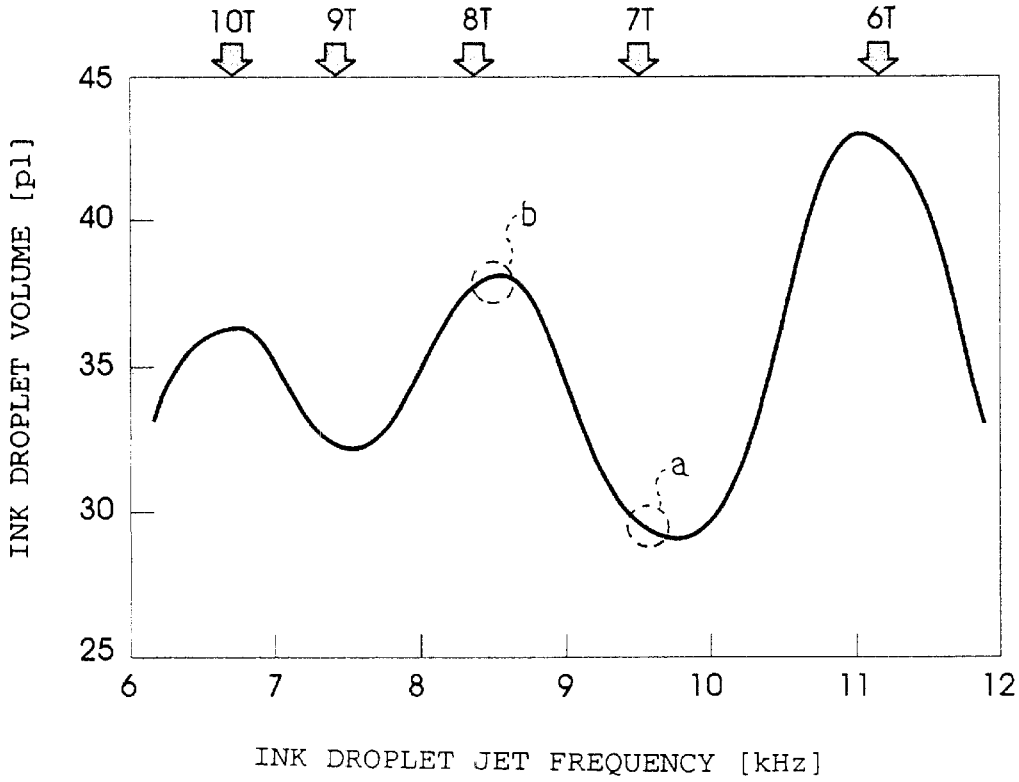
FIG. 2 is a graph showing measured data of volumes of droplets of ink obtained when the ink droplet jetting frequency is varied.

FIG. 2 is a characteristic graph (graph obtained by connecting a plurality of plotted values by lines) of measured data obtained when volumes of ink droplets were measured when dots were continuously printed by varying the ink droplet jet frequency. When the period is an even-numbered multiple (6T, 8T, 10T) of the time T, there is exhibited a characteristic in which the volume of ink droplets (or printing density) increase. When the period is an odd-numbered multiple (7T, 9T) of the time T, there is exhibited a characteristic in which the volume of ink droplets (or printing density) decrease. Accordingly, it is possible to change the volume of ink droplets by selecting the ink droplet period (or frequency which is the reciprocal thereof).

That is, when the volume of ink droplets of each dot is increased, the printing frequency of the predetermined timing period is set to a reciprocal of an even-numbered multiple of the time T in which a pressure wave propagates within the ink chamber. Also, when the volume of ink droplets of each dot is decreased, the printing frequency of the predetermined timing period is set to a reciprocal of an odd-numbered multiple of the time T in which a pressure wave propagates within the ink chamber. If the frequency corresponding to 7T in the illustrated area a, for example, is selected, then an ink droplet volume becomes approximately 30 pl (picoliter), which is suitable for printing with a resolution of 720 dpi.

Further, if a frequency corresponding to 8T in the illustrated area b is selected, then the ink droplet volume becomes about 38 pl, which is suitable for printing with a resolution of 360 dpi. If a frequency which is not the integral multiple of the time T, that is, a frequency corresponding to a time between 7T and 8T is selected, then printing with an intermediate resolution is possible. Incidentally, the period 7T is 105 $\mu$sec, and a frequency obtained at that time is approximately 9.5 kHz.

The printing frequency of the predetermined timing period may be set to a range centered around a reciprocal of an even-numbered multiple of the time T in which a pressure wave propagates within the ink chamber one-way when the printing density is increased. The range may be defined as (2N−0.4)×T to (2N+0.4)×T, wherein N is an integer. For the example above, the range for N=4, would be (8−0.4)T to (8+0.4)T, or 7.6T to 8.4T.

In addition, the printing frequency of the predetermined timing period may be set to be a range centered around a reciprocal of an odd-numbered multiple of the time T in which a pressure wave propagates within the ink chamber one-way when the printing density is decreased. The range may be defined as (2N−1.4)×T to (2N−0.6)×T, wherein N is an integer. For the example above, the range for N=4, would be (8−1.4)T to (8−0.6)T, or 6.6T to 7.4T.

Figure 3:
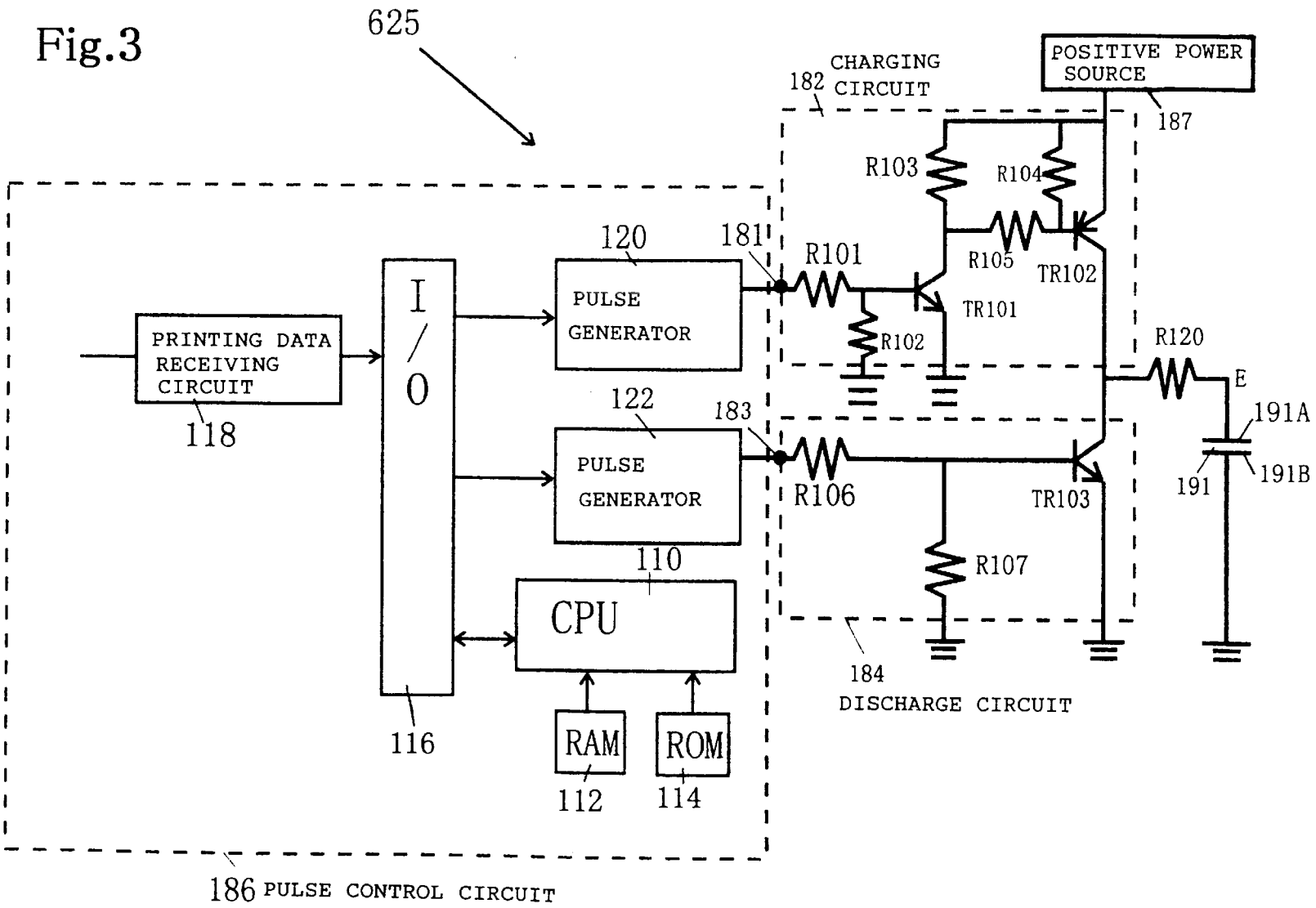
FIG. 3 a diagram showing a driving circuit of an ink droplet jetting apparatus.
Figure 4:
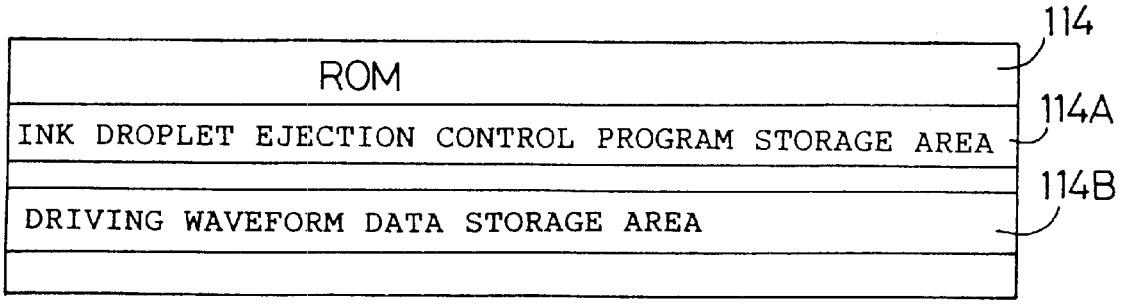
FIG. 4 is a diagram showing the storage area of the controller ROM for the ink droplet jetting apparatus.

A controller for realizing the aforementioned driving waveform 10 according to an embodiment will be described with reference to FIGS. 3 and 4. A controller 625 shown in FIG. 3 comprises a charging circuit 182, a discharging circuit 184 and a pulse control circuit 186. A piezoelectric material of an actuator wall 603 and electrodes 619, 621 are equivalently expressed by a capacitor 191. Reference numerals 191A and 191B denote the terminals thereof.

Input terminals 181 and 183 are those to which there are pulse signals input which are used to set voltages supplied to the electrode 619 disposed within the ink chamber 613 to E (V) and 0 (V), respectively. The charging circuit 182 comprises resistors R101, R102, R103, R104, R105 and transistors TR101, TR102.

When an ON signal (+5V) is input to the input terminal 181, the transistor TR101 is conducted through the resistor R101 so that a current flows from a positive power supply 187 through the resistor R103 to the transistor TR101 along the collector to the emitter direction. Therefore, divided voltages of the voltage applied to the resistors R104 and R105 connected to the positive power supply 187 are raised and a current which flows in the base of the transistor TR102 increases, thereby conducting the emitter-collector path of the transistor TR102. A voltage 20(V) from the positive power supply is applied through the collector and the emitter of the transistor TR102 and the resistor R120, to the capacitor 191 and the terminal 191A.

Figure 7A:
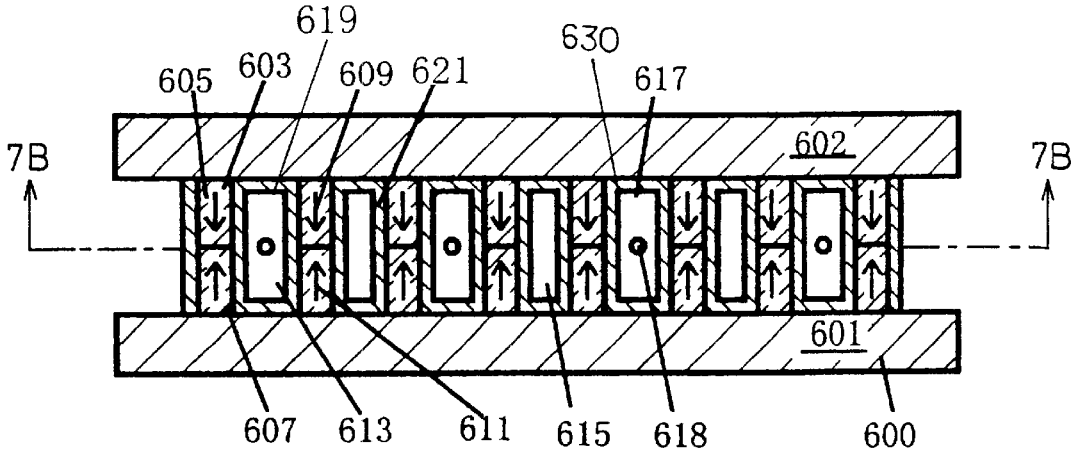
FIG. 7A is a longitudinal sectional view of an ink jet portion of a recording head.
Figure 7B:
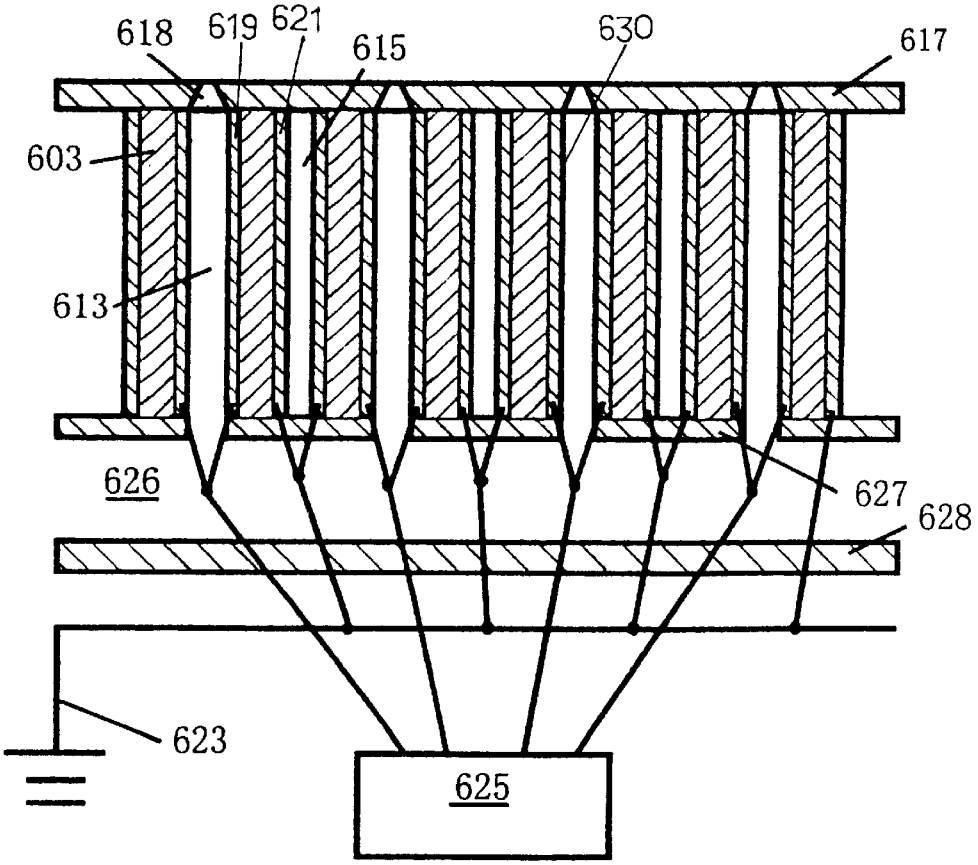
FIG. 7B is a cross-sectional view of FIG. 7A.
Figure 8:
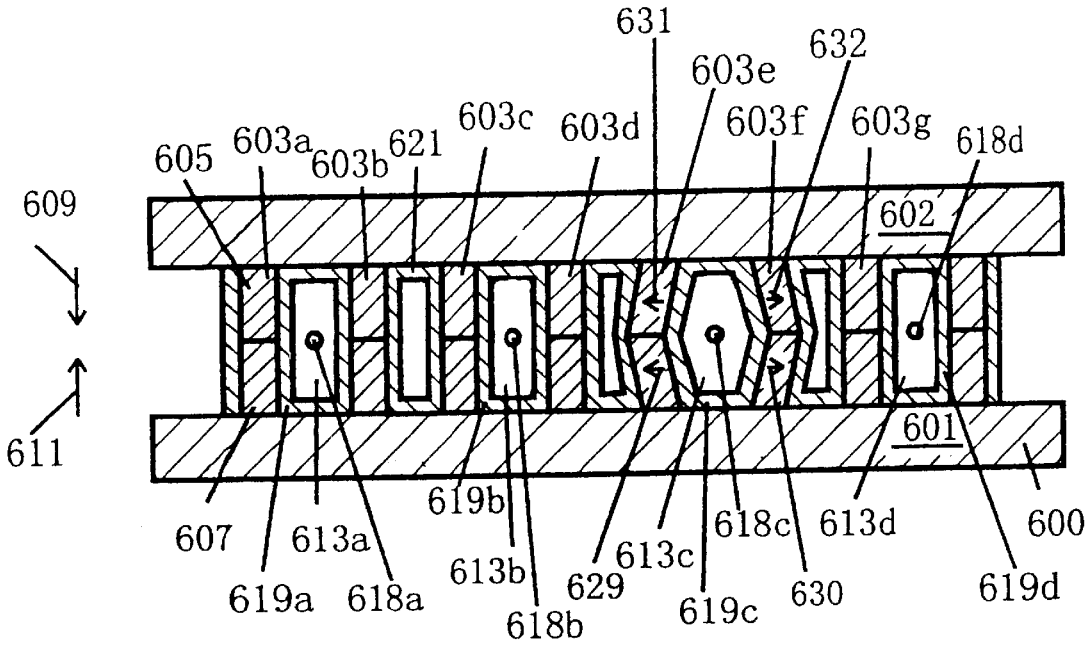
FIG. 8 is a longitudinal sectional view showing the operation of the ink jet unit of a recording head.

The discharging circuit 184 will be described next. The discharging circuit 184 comprises resistors R106, R107 and a transistor TR103. When an ON signal (+5V) is input to the input terminal 183, the transistor TR103 is conducted through the resistor R106, thereby resulting in the terminal 191A on the side of the resistor R120 of the capacitor 191 being connected to the ground through the resistor R120. Therefore, electric charges applied to the actuator wall 603 of the ink chamber 613 shown in FIGS. 7A, 7B and 8, are discharged.

The pulse control circuit 186 for generating pulse signals that are input to the input terminal 181 of the charging circuit 182 and the input terminal 183 of the discharging circuit 184 will be described next. The pulse control circuit 186 is provided with a CPU 110 for performing a variety of computations. To the CPU 110, there are connected a RAM 112 for memorizing printing data and a variety of other data and a ROM 114 for memorizing sequence data in which on/off signals are generated in accordance with a control program and a timing of the pulse control circuit 186. The ROM 114 includes, as shown in FIG. 4, an ink droplet jet control program storage area 114A and a driving waveform data storage area 114B. Therefore, the sequence data of the driving waveform 10 is stored in the driving waveform data storage area 114B.

In the driving waveform data storage area 114B, as the sequence data of the driving waveform 10, there are memorized such data in which the printing frequency is set to a reciprocal of an even-numbered multiple of the time T in which a pressure wave propagates within an ink chamber one-way when printing with a low resolution is executed and the volume of ink droplets in each dot is increased, and in which the printing frequency is set to a reciprocal of an odd-numbered multiple of the time T in which a pressure wave propagates within an ink chamber one-way when a printing with a high resolution is executed and the volume of ink droplets of each dot is decreased.

Further, the CPU 110 is connected to an I/O bus 116 for exchanging a variety of data. The printing data receiving circuit 118 and pulse generators 120 and 122 are also connected to the I/O bus 116. An output from the pulse generator 120 is connected to the input terminal 181 of the charging circuit 182, and an output from the pulse generator 122 is connected to the input terminal 183 of the discharging circuit 184.

The CPU 110 controls the pulse generators 120 and 122 in accordance with the sequence data memorized in the driving waveform data recording area 114B. Therefore, by memorizing data corresponding to resolutions in the driving waveform data storage area 114B within the ROM 114, in advance, it is possible to supply the drive pulse of the driving waveform 10 shown in FIGS. 1A and 1B to the actuator wall 603 at a predetermined timing period in response to a desired resolution set by a user with a resolution setting unit (not shown).

Incidentally, there are provided the pulse generators 120, 122, the charging circuit 182 and the discharging circuit 184 the numbers of which are the same as the number of the nozzles. While this embodiment typically describes the manner in which one nozzle is controlled, other nozzles are controlled similarly as described above.

Figure 5:
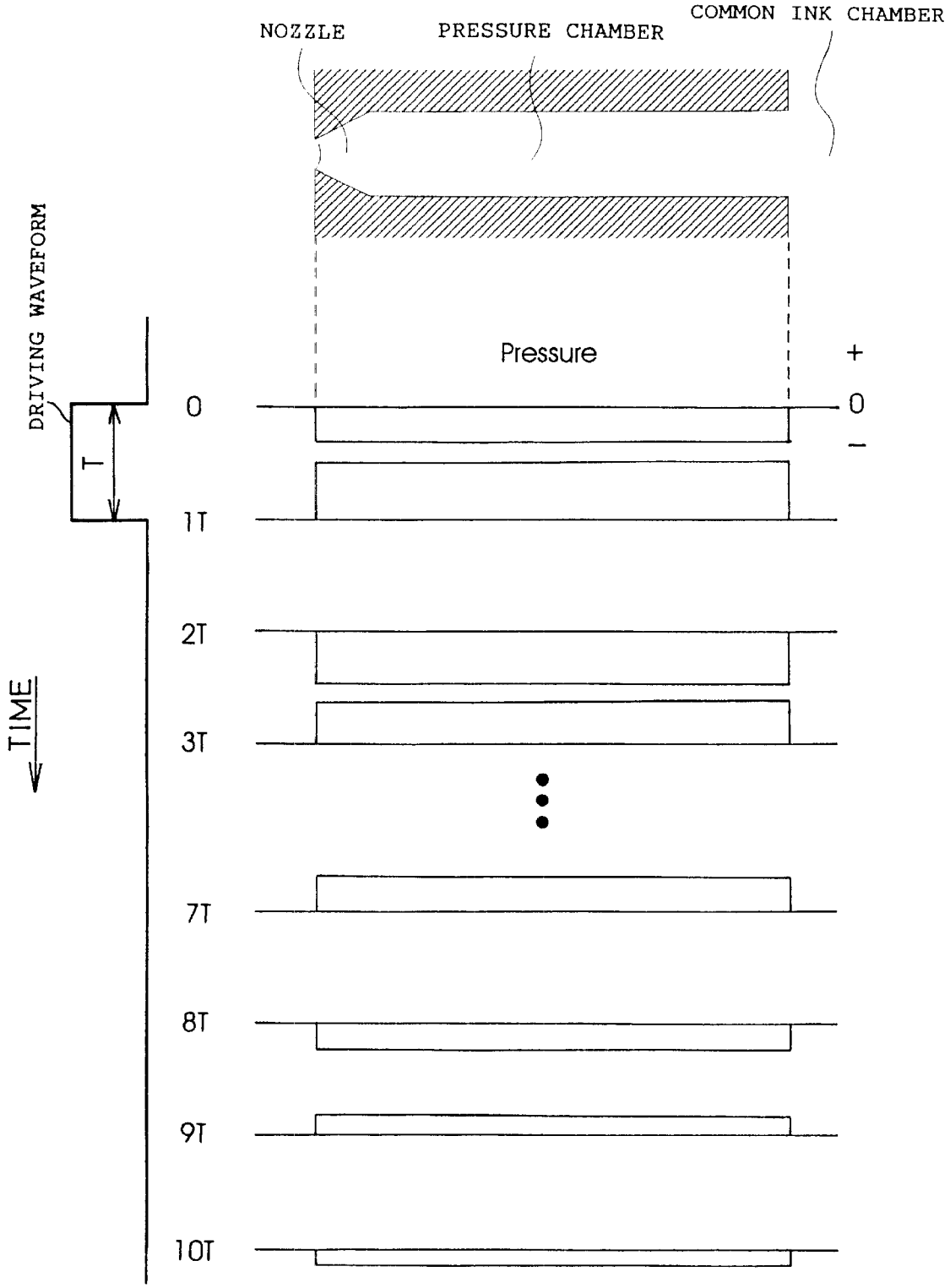
FIG. 5 is a diagram showing the manner in which the pressure within the pressure chamber is changed when the jet pulse is applied.

FIG. 5 is a diagram used to explain the manner in which the pressure within the ink chamber 613 is changed when a jet pulse is applied to the ink droplet jet apparatus 600. Reference numerals 1T to 10T denote time transitions. At the leading edge time 0 of the jetted pulse, the capacity of the pressure chamber increases to generate a pressure wave (negative pressure). At a trailing edge timing point of the jetted pulse obtained after the time 1T, the capacity of the pressure chamber is decreased to the natural state so that the pressure wave is increased (positive pressure). The positive pressure becomes the negative pressure during a time period of 2T. The phase of the pressure will hereinafter be inverted at every time T and attenuated. Since the pressure acts on the jet pulse as described above, if the ink droplet jet apparatus is continuously driven at an even-number multiple of the period T, then the speed and volume of the ink droplets increase. If the ink droplet jet apparatus is continuously driven an odd-number multiple of the period T, then the speeds and volumes of the ink droplets decrease. Therefore, if the ink droplet jet apparatus is driven at an intermediate period, then there may be obtained intermediate speed and volume of ink droplets.

Figure 6:
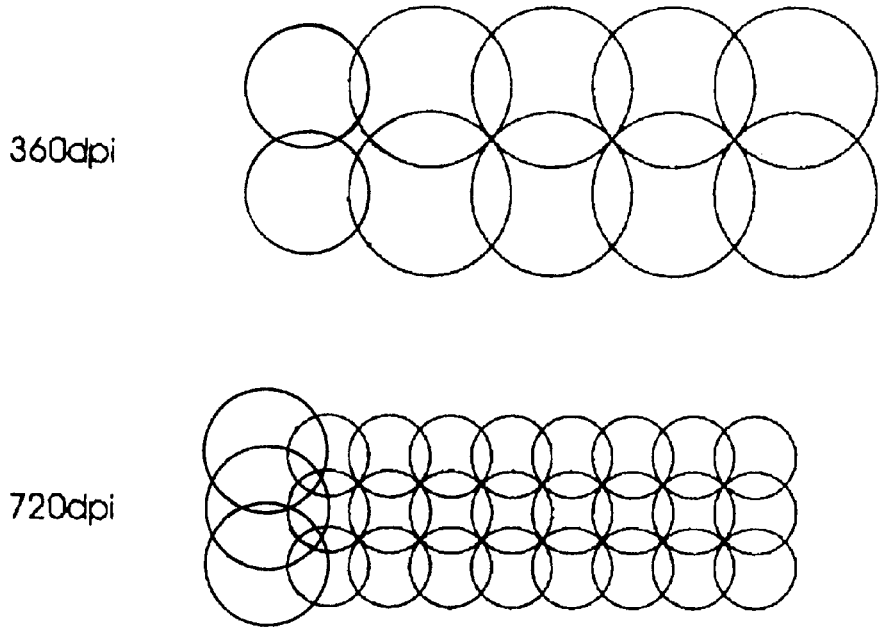
FIG. 6 is a diagram showing the states in which dots are continuously printed with a variety of resolutions.

FIG. 6 shows results obtained when dots were continuously printed with resolutions of 360 dpi and 720 dpi. The first dots printed on the left-hand side are the same size for each resolution. Then, the dots are either increased or decreased to a particular size depending on the desired resolution. For example, the printing resolution of 360 dpi may be obtained by driving the apparatus at a frequency corresponding to the period 8T, and the printing resolution of 720 dpi may be obtained by driving the apparatus at a frequency corresponding to the period 7T. Moreover, it is possible to realize printing with a gradation by varying frequencies in printing at an arbitrary portion in a group of image data, as described above.

While the embodiment has been described so far, the invention is not limited thereto. For example, while the timing period is changed in response to the desired volume of ink droplets of each dot as described above, the present invention is not limited thereto, and the timing period may be changed in response to the printing density. Moreover, while there is illustrated only the driving signal having one jet pulse signal A as the main driving signal, as described above, the invention is not limited thereto, and a main driving signal may comprise two jet pulses, for example. Also, the ink droplet jet apparatus 600 is not limited to the arrangement of the above-mentioned embodiment, and it is possible to use such an ink droplet jet apparatus in which a polarization direction of a piezoelectric material is reversed.

While the air chambers 615 are provided on both sides of the ink chamber 613 as described above, air chambers need not be provided, and ink chambers may be adjoining each other. Further, while the actuator is of a shearing mode type, the invention is not limited thereto, and the actuator may of such a type that piezoelectric materials are laminated and a pressure wave is generated by a deformation in the laminated direction. Also, the material is not limited to the piezoelectric material, so that any material which generates a pressure wave in an ink chamber may be used.

What is claimed is:

1. An ink droplet ejecting method, comprising:

applying a jet pulse signal to an actuator at a frequency of a timing period between jet pulse signals to jet an ink droplet from an ink chamber such that the actuator increases the volume of the ink chamber to generate a pressure wave in the ink chamber at a leading edge of the jet pulse signal, and the actuator decreases the volume of the ink chamber to apply pressure to the ink in the ink chamber and allows the ink droplet to be jetted at a trailing edge of the jet pulse signal, the frequency corresponding to a multiple of a time T in which a pressure wave caused by the jet pulse signal propagates within the ink chamber one way; and changing the frequency in response to a printing density.

2. The ink droplet ejecting method of claim 1, wherein the frequency is set to be a reciprocal of an even-numbered multiple of the time T when the printing density is increased.

3. The ink droplet ejecting method of claim 1, wherein the frequency is set to be a reciprocal of an add-numbered multiple of the time T when the printing density is decreased.

4. The ink droplet ejecting method of claim 1, wherein the frequency is set to be a range centered around a reciprocal of an even-numbered multiple of the time T when the printing density is increased, wherein the range is defined as $(2N-0.4)\times T$ to $(2N+0.4)\times T$, wherein N is an integer.

5. The ink droplet ejecting method of claim 1, wherein the frequency is set to be a range centered around a reciprocal of an odd-numbered multiple of the time T when the printing density is decreased, wherein the range is defined as $(2N-1.4)\times T$ to $(2N-0.6)\times T$, wherein N is an integer.

6. The ink droplet ejecting method of claim 1, wherein the printing density is a desired ink droplet volume for each dot.

7. The ink droplet ejecting method of claim 6, wherein the frequency is set to be a reciprocal of an odd-numbered multiple of the time T when the ink droplet volume for each dot is increased.

8. The ink droplet ejecting method of claim 6, wherein the frequency is set to be a reciprocal of an odd-numbered multiple of the time T when the ink droplet volume for each dot is decreased.

9. An ink droplet ejecting apparatus including:

an ink chamber filled with ink;

an actuator for changing volume of the ink chamber;

a driving device for applying a jet pulse signal to the actuator; and a controller that controls the driving device to apply the jet pulse signal at a frequency of a timing period between jet pulse signals to jet an ink droplet from the ink chamber the frequency corresponding to a multiple of a time T in which a pressure wave caused by the jet pulse propagates within the ink chamber one way, wherein the actuator increases the volume of the ink chamber to generate a pressure wave in the ink chamber at a leading edge of the jet pulse signal, and the actuator decreases the volume of the ink chamber to apply pressure to the ink in the ink chamber and allows the ink droplet to be jetted at a trailing edge of the jet pulse signal, wherein the controller changes the frequency in response to a printing density.

10. The ink droplet ejecting apparatus of claim 9, wherein the frequency is set to be a reciprocal of an even-numbered multiple of the time T when the printing density is increased.

11. The ink droplet ejecting apparatus of claim 9, wherein the frequency is set to be a reciprocal of an odd-numbered multiple of the time T when the printing density is decreased.

12. The ink droplet ejecting apparatus of claim 9, wherein the frequency is set to be a range centered around a reciprocal of an even-numbered multiple of the time T when the printing density is increased, wherein the range is defined as $(2N-0.4)\times T$ to $(2N+0.4)\times T$, wherein N is an integer.

13. The ink droplet ejecting apparatus of claim 9, wherein the is set to be a range centered around a reciprocal of an odd-numbered multiple of the time T when the printing density is decreased, wherein the range is defined as $(2N-1.4)\times T$ to $(2N-0.6)\times T$, wherein N is an integer.

14. The ink droplet ejecting apparatus of claim 9, wherein the printing density is a desired ink droplet volume of each dot.

15. The ink droplet ejecting apparatus of claim 14, wherein the frequency is set to be a reciprocal of an even-numbered multiple of the time T when the ink droplet volume of each dot is increased.

16. The ink droplet ejecting apparatus of claim 14, wherein the frequency is set to be a reciprocal of an odd-numbered multiple of the time T when the ink droplet volume of each dot is decreased.

17. The ink droplet ejecting apparatus of claim 9, wherein the trailing edge is after lapse of an odd-numbered multiple of the time T from the leading edge.

18. An ink droplet ejecting apparatus including:

an ink chamber filled with ink;

an actuator for changing volume of the ink chamber;

a driving device for applying a jet pulse signal to the actuator; and a controller that controls the driving device to apply the jet pulse signal at a frequency of a timing period between jet pulse signals to jet an ink droplet from the ink chamber the frequency corresponding to a multiple of a time T in which a pressure wave caused by the jet pulse propagates within the ink chamber one way, wherein the actuator increases the volume of the ink chamber to generate a pressure wave in the ink chamber at a leading edge of the jet pulse signal, and the actuator decreases the volume of the ink chamber to apply pressure to the ink in the ink chamber and allows the ink droplet to be jetted at a trailing edge of the jet pulse signal, wherein the controller changes the frequency in response to a printing resolution such that the frequency is set to be a reciprocal of an even-numbered multiple of the time T when the printing resolution is low, and the frequency is set to be a reciprocal of an odd-numbered multiple of the time T when the printing resolution is high.

19. The ink droplet ejecting apparatus of claim 18, wherein the trailing edge is after lapse of an odd-numbered multiple of the time T from the leading edge.

20. An ink droplet ejecting method, comprising:

applying a jet pulse signal to an actuator at a frequency of a timing period between jet pulse signals to jet an ink droplet from an ink chamber such that the actuator increases the volume of the ink chamber to generate a pressure wave in the ink chamber at a leading edge of the jet pulse signals, and the actuator decreases the volume of the ink chamber to apply pressure to the ink in the ink chamber and allows the ink droplet to be jetted at a trailing edge of the jet pulse signal, the frequency corresponding to a multiple of a time T in which a pressure wave caused by the jet pulse signal propagates within the ink chamber one way; and changing the frequency in response to a printing resolution, wherein the frequency is set to be a reciprocal of an even-numbered multiple of the time T when the printing resolution is low, and the frequency is set to be a reciprocal of an odd-numbered multiple of the time T when the printing resolution is high.

* * * * *